United States Patent [19]

Dang et al.

[11] Patent Number: 4,668,372

[45] Date of Patent: May 26, 1987

[54] METHOD FOR MAKING AN ELECTROLYTIC UNIT FROM A PLASTIC MATERIAL

[75] Inventors: Hiep D. Dang, Lake Jackson; Richard N. Beaver, Angleton, both of Tex.

[73] Assignee: The Dow Chemical Company, Midland, Mich.

[21] Appl. No.: 809,375

[22] Filed: Dec. 16, 1985

[51] Int. Cl.[4] ..... C25B 9/04; H01R 43/00

[52] U.S. Cl. ..... 204/279; 29/825; 204/280

[58] Field of Search ..... 204/253–258, 204/269, 279, 280; 29/825

[56] References Cited

U.S. PATENT DOCUMENTS

| | | | |
|---|---|---|---|
| 1,907,818 | 5/1933 | Hunter . | |
| 3,824,173 | 7/1974 | Bouy et al. | 204/284 |
| 3,849,279 | 11/1974 | Barkel | 204/254 |
| 3,873,437 | 3/1975 | Pulver | 204/254 |
| 3,909,378 | 9/1975 | Walmsley | 204/98 |
| 3,950,239 | 4/1976 | Figueras | 204/254 |
| 4,025,405 | 5/1977 | Dotson et al. | 204/98 |
| 4,029,565 | 6/1977 | Bender et al. | 204/256 |
| 4,032,423 | 6/1977 | Cunningham | 204/254 |
| 4,051,009 | 9/1977 | Schweickart et al. | 204/279 |
| 4,065,366 | 12/1977 | Oda et al. | 204/98 |
| 4,085,027 | 4/1978 | Poush et al. | 204/268 |
| 4,107,023 | 8/1978 | Mentz | 204/269 |
| 4,116,888 | 9/1978 | Ukihashi et al. | 521/31 |
| 4,123,336 | 10/1978 | Seko et al. | 204/98 |
| 4,126,588 | 11/1978 | Ukihashi et al. | 521/31 |
| 4,151,053 | 4/1979 | Seko et al. | 204/98 |
| 4,176,215 | 11/1979 | Molnar et al. | 521/27 |
| 4,178,218 | 12/1979 | Seko | 204/98 |
| 4,192,725 | 3/1980 | Dotson et al. | 204/98 |
| 4,209,635 | 6/1980 | Munekata et al. | 560/183 |
| 4,212,713 | 7/1980 | Suhara et al. | 204/98 |
| 4,251,333 | 2/1981 | Suhara et al. | 204/98 |
| 4,270,996 | 6/1981 | Suhara et al. | 204/98 |
| 4,329,435 | 5/1982 | Kimoto et al. | 521/38 |
| 4,330,654 | 5/1982 | Ezzell et al. | 526/243 |
| 4,337,137 | 6/1982 | Ezzell | 204/252 |
| 4,337,211 | 6/1982 | Ezzell et al. | 260/456 F |
| 4,340,680 | 7/1982 | Asawa et al. | 521/27 |
| 4,357,218 | 11/1982 | Seko | 204/98 |
| 4,358,412 | 11/1982 | Ezzell et al. | 260/968 |
| 4,358,545 | 11/1982 | Ezzell et al. | 521/27 |
| 4,488,946 | 12/1984 | Morris et al. | 204/98 |

*Primary Examiner*—Donald R. Valentine

*Attorney, Agent, or Firm*—James H. Dickerson, Jr.

[57] ABSTRACT

The invention is a method for making an electrolytic unit having a substantially planar, plastic, plastic member;

a plurality of horizontally and vertically spaced apart shoulders on each side of the plastic member projecting outwardly therefrom and annularly encircling and supporting a plurality of electrically conductive inserts which extend from an exterior face of a shoulder on one surface of the plastic member, through the plastic member, to an exterior face of a shoulder on an opposite surface of the plastic member; and a frame structure composed of at least one piece and having an internal surface which sealably receives the external peripheral edges of the plastic member;

said method comprising:

attaching in any order:

(a) a plurality of horizontally and vertically spaced apart shoulders to the plastic member;

(b) at least one portion of the frame structure to the peripheral edges of the plastic member; and (c) a plurality of cover pieces to at least a portion of the horizontally and vertically spaced apart shoulders on at least one side of the plastic member.

17 Claims, 2 Drawing Figures

METHOD FOR MAKING AN ELECTROLYTIC UNIT FROM A PLASTIC MATERIAL

The present invention is related to a bipolar electrolytic unit fabricated from a plurality of plastic parts assembled in a unique way. A plurality of such units positioned in operable combination are particularly useful in the production of chlorine and caustic.

BACKGROUND OF THE INVENTION

As used herein "electrolytic cell" means an assembly which at least includes an anode in an anode compartment and a cathode in a cathode compartment, wherein the anode compartment and the cathode compartment are separated by an ion exchange membrane.

"Electrolytic unit" means an assembly which at least includes two, oppositely-charged, electrode components separated by a plastic member.

"Electrode component" means an electrode or an element associated with an electrode such as a current distributor, grid, or current collector. The component may be in the form of a wire mesh, woven wire, punched plate, metal sponge, expanded metal, perforated or unperforated metal sheet, flat or corrugated lattice work, spaced metal strips or rods, or other forms known to those skilled in the art.

Chlorine and caustic are large volume, basic chemicals which are most frequently produced electrolytically from an aqueous solution of an alkali metal chloride in electrolytic cells. Recently, a variety of technological advances have occurred to minimize the gap between the anode and the cathode of an electrolytic cell to minimize the electrical resistance of the electrolytic cell, thus allowing the electrolytic cell to operate more efficiently. Advances include such things as dimensionally stable anodes, ion exchange membranes, depolarized electrodes, zero gap cell configurations, and solid polymer electrolyte membranes.

There are two basic types of electrolytic cells, bipolar and monopolar cells. A bipolar electrolytic cell consists of several electrochemical units in a series, in which each unit, except the two end units, acts as an anode on one side and a cathode on the opposing side. Electrolytic units are sealably separated by an ion exchange membrane, thereby forming an electrolytic cell, or series of electrolytic cells. Electrical energy is introduced into a terminal bipolar cell at one end of a series of bipolar cells, passes through the series of bipolar cells, and is removed from the terminal cell at the other end of the series. An alkali metal halide solution is fed into the anode compartment(s) where a halogen gas is generated at the anode. Alkali metal ions are selectively transported through the ion exchange active membrane(s) into the cathode compartment(s) where alkali metal hydroxides are formed.

To take advantage of the new technological advances, a variety of electrolytic unit designs have been proposed. However, many of these are quite complicated and require the use of expensive materials. An uncomplicated electrolytic unit employing readily available, inexpensive materials would be highly desirable. It is the object of this invention to provide such an electrolytic unit and a method for manufacturing such a unit.

SUMMARY OF THE INVENTION

The invention is a method for making an electrolytic unit having a substantially planar plastic member;

a plurality of horizontally and vertically spaced apart shoulders protruding outwardly from each side of the plastic member; wherein at least a portion of said shoulders annularly encircle and support an electrically conductive insert which extends from an exterior face of a shoulder on one surface of the plastic member, through the plastic member, to an exterior face of a shoulder on an opposite surface of the plastic member; and a frame structure surrounding the plastic member and composed of at least one piece; said frame structure having an internal surface which sealably receives the external peripheral edges of the plastic member;

said method comprising:

attaching in any order:

(a) a plurality of horizontally and vertically spaced apart shoulders to the plastic member;

(b) at least one portion of the frame structure to the peripheral edges of the plastic member; and (c) a plurality of cover pieces to at least a portion of the inserts on at least one side of the plastic member.

BRIEF DESCRIPTION OF THE DRAWINGS

The invention can be better understood by reference to the drawings illustrating the invention and wherein like reference numerals refer to like parts in the different drawing figures, and wherein.

DETAILED DESCRIPTION OF A PREFERRED EMBODIMENT OF THE INVENTION

Figure 1:
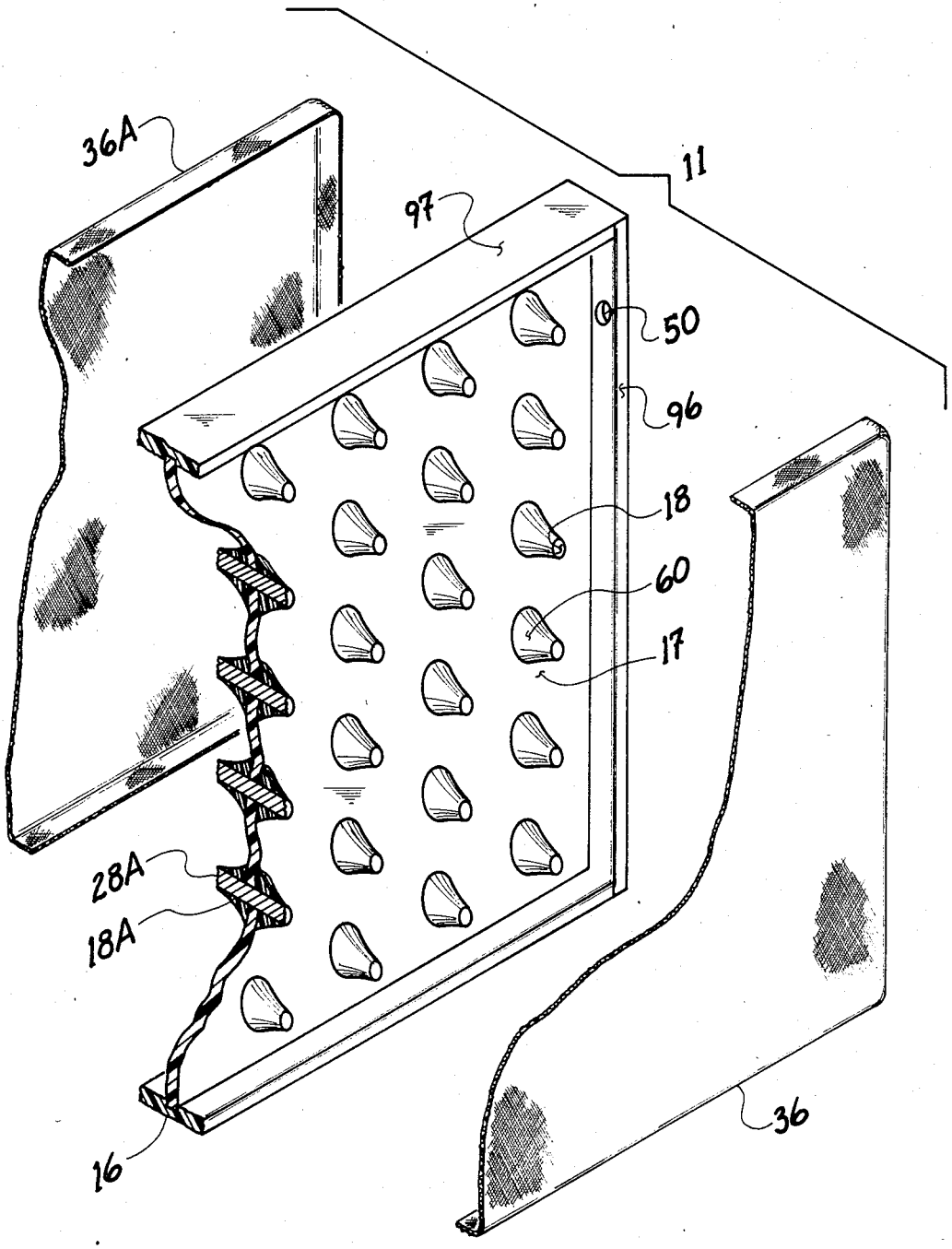
FIG. 1 is an exploded, partially broken away perspective view of one embodiment of the electrolytic unit of the present invention.
Figure 2:
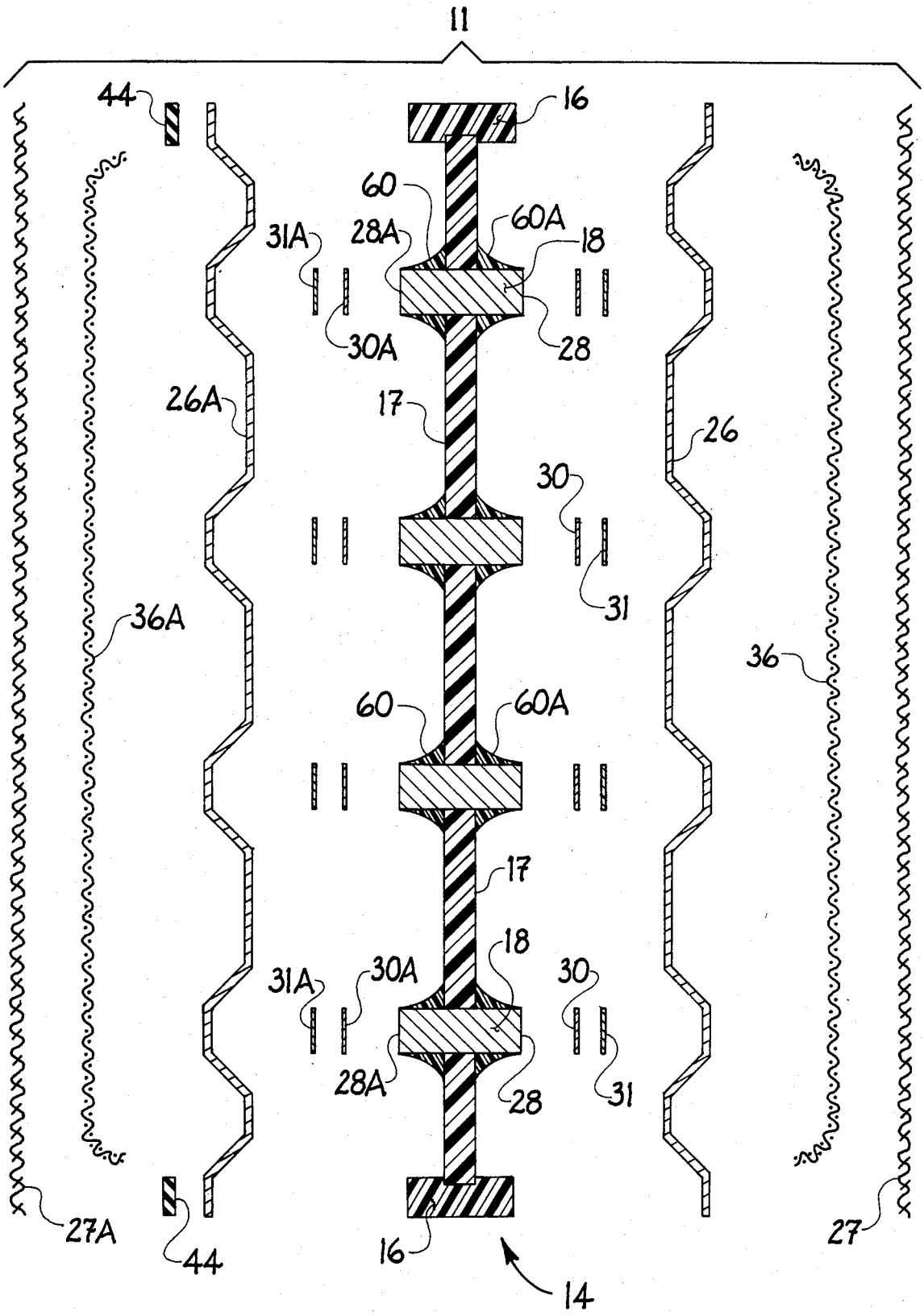
FIG. 2 is an exploded, sectional side view of one embodiment of the invention shown in FIG. 1.

The present invention uses a plastic member 17 as one component of the assembled electrolytic unit 11. Preferably, the plastic member 17 has sufficient structural integrity to provide a support for horizontally and vertically spaced apart inserts 18, frame structures 16, 96, and 97, and for a covers 26 and 26A. The plastic member 17 is substantially more massive and more rigid than the covers 26 or 26A and of any electrode components 36 and 36A normally used in electrolytic cells.

It is surprising that the plastic member 17 can be produced by processes well known to those in the art of plastic molding. Such molding processes include, for example, injection molding, compression molding, transfer molding, and casting. Of these processes, injection molding has been found to be preferable to produce a structure with adequate strength for use in an electrochemical cell. Preferably, the plastic is injected into a mold containing the desired number of inserts 18 (discussed later). In this manner, the plastic member fits tightly around the inserts 18, holds them in place, and provides a high degree of support to them. Such a configuration minimizes the likelihood that the inserts 18 will separate from the plastic member 17 and become loose. The ease of molding relatively complex shapes and the strength of the finished injection molded article contribute to making this process preferred for making the herein described structural member. This production method provides a considerable advantage over methods of the prior art where the plastic member 17 was molded first and then the electrical conductors were subsequently installed.

A number of plastic materials are suitable for use in the present invention for the construction of plastic member 17. Without intending to be limited by the specific organic materials hereinafter delineated, examples of such suitable materials include polyethylene; polypropylene; polyvinylchloride; chlorinated polyvinyl chloride; acrylonitrile, polystyrene, polysulfone, styrene acrylonitrile, butadiene and styrene copolymers; epoxy; vinyl esters; polyesters; and fluoroplastics and copolymers thereof. It is preferred that a material such as polypropylene be used for the structural member since it produces a shape with adequate structural integrity at elevated temperatures, is readily available, and is relatively inexpensive with respect to other suitable materials.

It is preferred that a material such as polypropylene be used for the plastic member 17 since it produces a shape with adequate structural integrity at elevated temperatures, is readily available, and is relatively inexpensive with respect to other suitable materials.

When the plastic member 17 is employed in an electrochemical cell for producing chlorine, the temperature of the cell and the plastic member will frequently reach, or be maintained at, temperatures of from about 60° to about 90° Celsius. At these temperatures plastics, as do most materials, expand a measurable amount. Any expansion and later contraction on cooling of the plastic member 17 could result in electrolyte seeping from within the plurality of cells when joined together or, more importantly, could result in distortion of the anode and cathode which are made of metallic expanded mesh or perforated sheets. Furthermore, the differential expansion between the plastic member 17 and the cover 26 or **26*a* would create stress on the welds which affix these covers to the inserts 18 which are themselves molded in the plastic member 17**.

To reduce, and preferably minimize, the difference in expansion between the covers 26 and 26A and the plastic member 17, it is preferred to incorporate an additive to reduce thermally induced expansion of the plastic member. More preferably, the additive will also increase the structural strength of the finished plastic article. Such additive can be, for example, fiberglass, graphite fibers, carbon fibers, talc, glass beads, pulverized mica, asbestos, and the like, and combinations thereof. It is preferred that the plastic contain from about 5 to about 75 weight percent and more preferably from about 10 to about 40 weight percent of the additive. Glass fibers can be readily mixed with polypropylene to produce an injectable material suitable for use in the present invention which results in a solid, physically strong body with a coefficient of expansion less than polypropylene not containing glass fibers. Of greater importance is the need to minimize the difference in expansion between the plastic member, the electrodes, and the current collector, since these elements are welded together and it is critical that they remain substantially flat and parallel.

It has been determined that the use of commercially available polypropylene which has been specially formulated to afford bonding with the glass works particularly well. This results in a composite having a lower coefficient expansion than a mixture of polypropylene and glass fibers. Such chemically-combined glass fiber reinforced polypropylene is available from, for example, Hercules, Inc., Wilmington, Del., as Pro-fax PC072 polypropylene.

A plurality of horizontally and vertically spaced apart shoulders 60 and 60A are attached on opposing sides of the plastic member 17. These horizontally and vertically spaced apart shoulders 60 and 60A project a predetermined distance outwardly from the plastic member 17 into an area that will ultimately become an electrolyte compartment, when a plurality of electrolytic units 11 are assembled to form a plurality of electrolytic cells.

The number, size, and shape of these horizontally and vertically spaced apart shoulders 60 and 60A may be an important consideration in both the design and operation of the present invention. They may be square, rectangular, conical, cylindrical, or any other convenient shape when viewed in sections taken either parallel or perpendicular to the central portion. The horizontally and vertically spaced apart shoulders 60 and 60A may have an elongated shape to form a series of spaced ribs distributed over the surface of the plastic member.

At least one electrically conducting insert, such as insert 18, is positioned and preferably molded into the plastic member 17. The insert 18 extends through the plastic member from one surface of the plastic member 17 to the other surface of the plastic member 17. The inserts 18 are preferably retained within the plastic member 17 by means of friction between the plastic and the insert 18. It is more preferable to increase the friction between these two bodies by having an additional means to restrain the insert 18 within the plastic. Such additional means include, for example grooves (one or more) around the circumference of the insert(s), keys welded to the insert 18, hole(s) extending into and/or through the insert 18, slots, rings, collars, studs, or bosses. These surfaces are adapted to be attached to a liner, intermediate coupons (30, 30A, 31 or 31A), or to an electrode component.

The insert 18 can be any material which will permit flow of an electric current between the covers 26 and **26*a*. Since the covers 26 or 26*a* are preferably metallic, it is convenient to fabricate the insert 18** from a metal, such as aluminum, copper, iron, steel, nickel, titanium, and the like, or alloys or physical combinations including such metals.

Preferably the ends of the inserts 18 on one side of the plastic member lie in the same geometrical plane and the ends of the inserts 18 on the other side of the plastic member lie in the same geometrical plane. This can be assured during a flattening step of the assembly process of the electrolytic units of the present invention. Preferably, the inserts 18 are substantially solid. They may, however, contain internal voids, as a result of their formation.

The inserts 18 are preferably spaced apart in a fashion so they can rigidly support any electrode components 36 and 36A desired for use in the electrolytic cell. The distance between the inserts 18 will generally depend upon the plane resistivity of the particular electrode element used. For thinner and/or highly resistive electrode elements, the spacing of the inserts 18 will be less, thus providing a more dense multiplicity of points for electrical contact. For thicker and/or less resistive electrode components 36 and 36A, the spacing of the inserts 18 may be greater. Normally the spacing between the inserts 18 is within 5 and 30 centimeters although small and larger spacing may be used in accordance with the overall design considerations.

Surrounding the peripheral edges of the plastic member 17 is a window-frame type frame structure. It has a thickness greater than, or at least equal to, the length of an insert 18 present in the plastic member 17. Preferably the frame structure extends further from the plane of the plastic member 17 than do the ends of the inserts 18. This provides a space for electrode components 36 and 36A that will be present when the electrolytic unit 11 of the present invention are stacked adjacent to each other in operable combination. Preferably the thickness of the frame structure is at least about 2–6 times greater than the thickness of the plastic member 17 (not including the thickness of the shoulders). More preferably, the flange structure is about 60–70 millimeters thick when the plastic member 17 is about 20–25 millimeters thick.

The frame structure 16 may be made from a variety of materials. The material may be the same or different from the material used to form the plastic member 17. Preferably the material is selected from the group consisting of polyethylene; polypropylene; polyvinylchloride; chlorinated polyvinyl chloride; acrylonitrile, polystyrene, polysulfone, styrene acrylonitrile, butadiene and styrene copolymers; epoxy; vinyl esters; polyesters; and fluoroplastics; copolymers thereof; iron, cast iron, ductile iron, steel, stainless steel, nickel, aluminum, copper, magnesium, lead, alloys of each and alloys thereof.

The frame structure 16 may be a one-piece, picture frame type structure or it may be a plurality of pieces joined together to form a structure surrounding the peripheral edges of the plastic member 17. The frame structure 16 is preferably thicker than the plastic member 17. The edges of the frame structure 16 lie in approximately the same plane as do the ends of the inserts 18.

The frame structures, if not formed as a one piece body with the plastic member 17, are preferably firmly attached to the plastic member 17. This firm attachment assures the dimensional stability of the electrolytic units and maintains the desired gap between electrode components of adjoining electrolytic units. Preferably, the frame structures are attached to the central support barrier 17 by bonding.

When a plurality of electrolytic units 11 are assembled in operable combination, an ion exchange membrane 27 and 27A is positioned between adjoining electrolytic units 11. The ion exchange membrane 27 and 27A suitable for use with the present invention may contain a variety of ion exchange active sites. For example, they may contain sulfonic or carboxylic acid ion exchange active sites. Optionally, the ion exchange membrane 27 and 27A may be bi-layer membranes and have one type of ion exchange active site in one layer and another type of ion exchange active sites in the other layer. The membranes may be reinforced to impair deforming during electrolysis or they may be unreinforced to maximize the electrical conductivity through the membrane.

The ion exchange membrane may preferably contain sulfonic ion exchange groups, carboxylic ion exchange groups, or both sulfonic and carboxylic acid ion exchange groups. Optionally, the ion exchange membrane may be a bi-layer membrane having one type of ion exchange active sites in one layer and another type of ion exchange active sites in the other layer. The membrane may be reinforced to impair deforming during electrolysis or it may be unreinforced to maximize the electrical conductivity throughout the membrane.

Representative of the types of ion exchange membrane 27 and 27A suitable for use in assembling a plurality of electrolytic units 11 are disclosed in the following U.S. Pat. Nos.: 3,909,378; 4,025,405; 4,065,366; 4,116,888; 4,123,336; 4,126,588; 4,151,053; 4,176,215; 4,178,218; 4,192,725; 4,209,635; 4,212,713; 4,251,333; 4,270,996; 4,329,435; 4,330,654; 4,337,137; 4,337,211; 4,340,680; 4,357,218; 4,358,412; and 4,358,545. These patents are hereby incorporated by reference for the purpose of the membranes they disclose.

It is within the scope of this invention for the electrolytic cells formed when a plurality of the electrolytic units 11 of the present invention are positioned in operable combination to be a multi-compartment electrolysis cell using more than one ion exchange membrane 27 and 27A, e.g., a three compartment cell with two ion exchange membrane 27 and 27A spaced apart to form a compartment between them as well as the compartment formed on the opposite side of each membrane between each membrane and its respective adjacent electrode component.

Additionally, other elements may be used in conjunction with components. Special elements or assemblies for zero gap configurations or solid polymer electrolyte membranes may be used. Also, the units of the present invention may be adapted for a gas chamber for use in conjunction with a gas-consuming electrode, sometimes called a depolarized electrode. The gas chamber is required in addition to the liquid electrolyte compartments. A variety of cell elements which may be used in the present invention are well known to those skilled in the art and are shown in a variety of patents, for example, U.S. Pat. Nos. 4,457,823; 4,457,815; 4,444,623; 4,340,452; 4,444,641; 4,444,639; 4,457,822; and 4,448,662.

A cover 26 or 26A is positioned over the area of the electrolytic unit 11 which will be contacted with corrosive environments when the electrolytic unit 11 is used in electrolytic processes. Optionally, the frame structures 16, 96, and 97 may also be lined, even though they may not be exposed to a corrosive environment. Optionally, a cover 26 or 26A may be positioned on both sides of the electrolytic unit 11 of the present invention. The cover 26 or 26A may be coextensive with only the portion of the plastic member 17 containing the horizontally and vertically spaced apart shoulders 60 and 60A, or it may be coextensive with the entire length and width of the entire plastic member 17 and the frame structures 16, 96, and 97.

The cover 26 or 26A may be composed of a plurality of pieces bonded together (not shown). Preferably the cover is of a thickness sufficient to be substantially completely hydraulically impermeable.

Covers are preferably formed with a minimum of stresses in them to minimize warpage. Avoiding these stresses in the cover may be accomplished by hot forming the cover in a press at an elevated temperature of about 480° Celsius (900° Fahrenheit) to about 700° Celsius (1300° Fahrenheit). Both the metal for the cover and a metal press are heated to this elevated temperature before pressing the metal into the desired cover shape. The cover is held in the heated press and cooled under a programmed cycle to prevent formation of stresses in it as it cools to room temperature.

Covers 26 or 26A which are suitable for use in chlor-alkali cathode compartments are preferably selected from the group consisting of ferrous materials, nickel, stainless steel, chromium, monel and alloys thereof.

Covers 26 or 26A which are suitable for use in chlor-alkali anode compartments are preferably selected from the group consisting of titanium, vanadium, tantalum, columbium, hafnium, zirconium, and alloys thereof.

To assure the maximum physical and electrical contact between the cover and the inserts 18, it is preferred for the cover to be welded to the ends of the inserts 18. Optionally, the cover can be welded not only at the ends of the inserts 18, but at various other places where the two contact each other. Capacitor discharge welding is a preferred welding technique to be used to weld the cover to the inserts 18.

If the covers 26 and 26A are titanium and the inserts 18 are a ferrous material, they may be connected by resistance welding or capacitor discharge welding. Resistance or capacitor discharge welding is accomplished indirectly by welding the covers 26 and 26A to the ends 28 and 28A of the inserts 18 and 18A through vanadium wafers 30 or 30A. Vanadium is a metal which is weldably compatible with titanium and ferrous materials. Weldably compatible means that one weldable metal will form a ductile solid solution with another weldable metal upon the welding of the two metals together. Titanium and ferrous materials are not normally compatible with vanadium. Hence, vanadium wafers 30 and 30A are used as an intermediate metal between the ferrous inserts 18 and the titanium covers 26 and 26A to accomplish the welding of them together to form an electrical connection between covers 26 and 26A and the inserts 18 as well as to form a mechanical support means for the inserts 18 to supporting covers 26 and 26A.

Preferably, a second wafer 31 and 31A are used and placed between wafers 30 and 30A and the covers 26 and 26A. The second wafer is preferable because when only one wafer is used, it has been discovered that the corrosive materials contacting the cover during operation of the cell to produce chlorine and caustic seem to permeate into the titanium-vanadium weld and corrode the weld. The corrosive materials also permeate into the body of the insert 18 and corrode it. Rather than use a thicker pan, it is much more economical to insert a second wafer 31 and 31A. The second wafer 31 and 31A is preferably sufficiently thick to minimize the possibility of the corrosive materials permeating into the insert 18.

For fluid sealing purposes between the membrane 27 or 27A, and sealing means surface 16A or 16C, it is preferred for cover 26 or 26A to be formed in the shape of a pan with an off-set lip 42 or 42A extending around its periphery. Lip 42 and 42A fits flush against the lateral face 16A or 16C of frame structure 16. The periphery of membrane 27 or 27A fits flush against cover lip 42, and a peripheral gasket 44 fits flush against the other side of the periphery of the membrane 27 or 27A. In a series of electrolytic units, the gasket 44 fits flush against the lateral face 42A of the cover 26A and flush against the lateral face 16C of the frame structure 16 when there is no cover.

To introduce reactants into the electrolytic cells formed when a plurality of electrolytic units 11 are stacked in operable combination, a plurality of nozzles are preferably present in each electrolytic unit 11. Although a variety of designs and configurations may be used, a preferred design is as follows. A plurality of metallic nozzles are formed, for example by investment casting. The nozzle casting is then machined to the desired size. A number of slots 50 are machined into each frame structure 16 at a plurality of desired positions to receive the nozzles. The slots are of a size to correspond to the thickness of the nozzle to be inserted into the slot, to assure a seal when the elements of the electrolytic cell are ultimately assembled. A cover 26 or 26A is cut to fit around the nozzle. The nozzle is preferably attached to the cover 26 or 26A, for example, by welding. The cover 26 or 26A-nozzle combination is then placed into the electrolytic unit 11. The cover 26 or 26A are then welded to the inserts 18.

When a plurality of electrolytic units 11 are assembled adjacent to each other, gaskets 44 are preferably positioned between the electrolytic units 11. The gaskets serve three main functions: sealing, electrical insulation and setting the electrode gap. There are a variety of suitable gasket materials that may be suitably used, for example, ethylenepropylenediene terpolymer, chlorinated polyethylene, polytetrafluoroethylene, perfluoroalkoxy resin. Although only one gasket 44 is shown, the invention certainly encompasses the use of gaskets on both sides of membrane 27 or 27A.

Adjacent to the cover 26 or 26A is an electrode component 36 and 36A, respectively. The electrode components 36 and 36A may be attached to the cover 26 or 26A or they may be merely pressed against the cover 26 or 26A or the plastic member 17. Preferably, the electrode components are welded because the electrical contact is better. Preferably, the electrode component is coextensive with the plastic member 17 and does not extend into the frame structure 16 area. Otherwise, it would be difficult to seal adjacent electrolytic units 11 when they are placed in operable combination.

Electrode components are preferably foraminous structures which are substantially flat and may be made of a sheet of expanded metal perforated plate, punched plate or woven metallic wire. Optionally, the electrode components may be current collectors which contact an electrode or they may be electrodes. Electrodes may optionally have a catalytically active coating on their surface.

Additionally, other elements may be used in conjunction with components. Special elements or assemblies for zero gap configurations or solid polymer electrolyte membranes may be used. Also, the units of the present invention may be adapted for a gas chamber for use in conjunction with a gas-consuming electrode, sometimes called a depolarized electrode. The gas chamber is required in addition to the liquid electrolyte compartments. A variety of cell elements which may be used in the present invention are well known to those skilled in the art and are shown in a variety of patents, for example, U.S. Pat. Nos. 4,457,823; 4,457,815; 4,444,623; 4,340,452; 4,444,641; 4,444,639; 4,457,822; and 4,448,662.

Preferably, the flat surfaces of the electrode components 36 and 36A have their edges rolled inwardly toward the plastic member 17 and away from the ion exchange membrane 27 and 27A. This is done to prevent the sometimes jagged edges of these electrode components 36 and 36A from contacting the ion exchange membrane 27 and 27A and tearing it.

The electrolytic unit 11 of the present invention may be prepared in a variety of ways using a variety of elements. There are, however, three main categories of elements used in making the electrolytic units of the present invention:

(1) plastic member 17;

(2) frame structures 16, 96, and 97;

(3) horizontally and vertically spaced apart shoulders 60 and 60A; and (4) inserts 18.

Within each of these categories, each element may be composed of a plurality of pieces. For example, the plastic member 17 may be a plurality of pieces joined together. Likewise, the frame structure may be a plurality of pieces joined together. Similarly, the horizontally and vertically spaced apart shoulders 60 and 60A may be one piece units or multiple piece units which are merely attached to one surface thereof.

The four types of elements are combined in a manner to form the electrolytic unit described herein, but, as can be seen, there are a variety of sequences that may be followed in assembling the three types of elements to form an electrolytic unit. For example, the elements may be assembled by, first, putting the inserts in position, attaching the horizontally and vertically spaced apart shoulders 60 and 60A to the plastic member 17 and then attaching the frame structures 16, 96, and 97 to the periphery of the plastic member 17. Or, another sequence may be used in which the frame structures 16, 96, and 97 are first attached to the plastic member 17 and then the horizontally and vertically spaced apart shoulders 60 and 60A are attached, followed by insertion of the inserts 18.

To assure that the electrolytic unit 11 of the present invention is as a planar as possible, it is optional to flatten the surfaces of the assembled, or partially assembled, electrolytic units. The electrolytic unit may be flattened at any one, or more, of the various steps of assembly of the electrolytic unit. For example, it may be flattened:

after all of the horizontally and vertically spaced apart shoulders 60 and 60A and inserts 18 have been attached to one side of the plastic member 17;

after only a portion of the horizontally and vertically spaced apart shoulders 60 and 60A and inserts 18 have been attached to the plastic member 17;

after all or a portion of the horizontally and vertically spaced apart shoulders 60 and 60A and inserts 18 have been attached to the plastic member 17 but before the frame structures 16, 96, and 97 have been attached; or after all the horizontally and vertically spaced apart shoulders 60 and 60A, the inserts 18, and the frame structures 16, 96, and 97 have been attached.

The electrolytic unit of the present invention may be flattened using a variety of techniques well known to those skilled in the art, such as abrasive belt grinding, and mechanical milling. Preferably, the finished electrolytic unit 11 is sufficiently flattened such that when two electrolytic units are mated with each other in operable combination, the number of leaks is minimized. For use in chlor-alkali electrochemical cells, it is most preferred for the electrolytic unit 11 to have a flatness deviation of less than about 0.4 millimeters (0.015 inch) throughout its entire mass.

Attaching the inserts 18 to the plastic member 17 may be done using a variety of techniques. For example, the plastic member 17 may be cast as a solid unit and later have holes drilled and tapped through its thickness, or partially through its thickness. The inserts 18 can be threaded and then screwed into the holes in the plastic member 17 from both sides. Optionally, the inserts 18 can be threaded through half their length and they can be screwed half way through the plastic member 17. Preferably, the ends of the inserts are machined flattened before they are attached to the plastic member 17.

The horizontally and vertically spaced apart shoulders 60 and 60A may be bonded to the plastic member 17 and to the inserts 18 is by, for example, gluing.

In operating the cell series as an electrolysis cell series for NaCl brine, certain operating conditions are preferred. In the anode compartment a pH of from about 0.5 to about 5.0 is desired to be maintained. The feed brine preferably contains only minor amounts of multivalent cations (less than about 80 parts per billion when expressed as calcium). More multivalent cation concentration is tolerated with the same beneficial results if the feed brine contains carbon dioxide in concentrations lower than about 70 ppm when the pH of the feed brine is lower than 3.5.

Operating temperatures can range from 0° to 110° Celsius, but preferably from about 60° Celsius to about 80° Celsius. Brine purified from multivalent cations by ion-exchange resins after conventional brine treatment has occurred is particularly useful in prolonging the life of the solid polymer electrolyte membrane. A low iron content in the feed brine is desired to prolong the life of the solid polymer electrolyte membrane. Preferably the pH of the brine feed is maintained at a pH below 4.0 by the addition of hydrochloric acid.

Preferably the operating pressure is maintained at less than 7 atmospheres.

Usually the cell is operated at a current density of from about 1.0 to about 4.0 amperes per square inch, but in some cases operating above 4.0 amps/in.$^2$ is quite acceptable.

We claim:

1. A method for making an electrolytic unit having a substantially planar plastic member;

a plurality of horizontally and vertically spaced apart shoulders protruding outwardly from each side of the plastic member; wherein at least a portion of said shoulders annularly encircle and support an electrically conductive insert which extends from an exterior face of a shoulder on one surface of the plastic member, through the plastic member, to an exterior face of a shoulder on an opposite surface of the plastic member; and a frame structure surrounding the plastic member and composed of at least one piece; said frame structure having an internal surface which sealably receives the external peripheral edges of the plastic member;

said method comprising:

(a) attaching in any order:

a plurality of horizontally and vertically spaced apart shoulders to the plastic member;

at least one portion of the frame structure to the peripheral edges of the plastic member; and a plurality of cover pieces to at least a portion of the inserts on at least one side of the plastic member; and (b) flattening the assembled unit after all the inserts have been attached.

2. The method of claim 1 including attaching at least one electrode component to the cover(s).

3. The method of claim 1 wherein the cover is made from a metal selected from the group consisting of ferrous materials, nickel, stainless steel, chromium, monel, titanium, vanadium, tantalum, columbium, hafnium, zirconium, and alloys thereof.

4. The method of claim 1 wherein the frame structures are attached to the plastic member by bonding.

5. The method of claim 1 wherein the horizontally and vertically spaced apart shoulders are attached to both sides of the plastic member.

6. The method of claim 1 wherein both of the shoulder-containing sides of the plastic member are covered with a cover.

7. The method of claim 6 wherein the cover is attached to the ends of the inserts by welding.

8. The method of claim 1 wherein the frame structures are constructed of materials selected from the group consisting of polyethylene; polypropylene; polyvinylchloride; chlorinated polyvinyl chloride; acrylonitrile, polystyrene, polysulfone, styrene acrylonitrile, butadiene and styrene copolymers; epoxy; vinyl esters; polyesters; fluoroplastics; copolymers thereof; iron, cast iron, ductile iron, steel, stainless steel, nickel, aluminum, copper, magnesium, lead, alloys of each and alloys thereof.

9. The method of claim 1 wherein the horizontally and vertically spaced apart shoulders are constructed from a material selected from the group consisting of polyethylene; polypropylene; polyvinylchloride; chlorinated polyvinyl chloride; acrylonitrile, polystyrene, polysulfone, styrene acrylonitrile, butadiene and styrene copolymers; epoxy; vinyl esters; polyesters; fluoroplastics; and copolymers thereof.

10. The method of claim 1 wherein the insert is a metal selected from the group consisting of aluminum, copper, iron, steel, nickel, titanium, and alloys thereof.

11. The method of claim 1 wherein the plastic member is made from a material selected from the group consisting of polyethylene; polypropylene; polyvinylchloride; chlorinated polyvinyl chloride; acrylonitrile, polystyrene, polysulfone, styrene acrylonitrile, butadiene and styrene copolymers; epoxy; vinyl esters; polyesters; fluoroplastics; and copolymers thereof.

12. The method of claim 1 wherein the plastic contains an additive selected from the group consisting of fiberglass, graphite fibers, carbon fibers, talc, glass beads, asbestos, and pulverized mica.

13. The method of claim 12 wherein the plastic contains from about 5 to about 75 weight percent of the additive.

14. The method of claim 12 wherein the plastic contains an additive to reduce thermally induced expansion of said plastic member.

15. The method of claim 1 wherein at least one cover is made from a metal selecteed from the group consisting of titanium, tantalum, zirconium, tungsten, and alloys thereof.

16. The method of claim 1 wherein at least one cover is made from a metal selected from the group consisting of iron, steel, stainless steel, nickel, lead, molybdenum, cobalt, and alloys thereof.

17. The method of claim 1 wherein said covers are attached directly to said insert.

* * * * *